United States Patent [19]

Lemke

[11] Patent Number: 5,035,028

[45] Date of Patent: Jul. 30, 1991

[54] ROOF FASTENER ASSEMBLY INCLUDING A DUAL PLATE STRESS RELIEVER

[76] Inventor: Stuart H. Lemke, 349 River Bluff, Mosinee, Wis. 54455

[21] Appl. No.: 395,962

[22] Filed: Aug. 18, 1989

[51] Int. Cl.[5] ..... F04D 5/14

[52] U.S. Cl. ..... 24/336; 52/410; 52/547; 52/548; 52/748

[58] Field of Search ..... 52/544, 547, 548, 549, 52/543, 410, 58, 60, 741, 747, 748; 160/380, 371; 135/119; 24/336

[56] References Cited

U.S. PATENT DOCUMENTS

| | | | |
|---|---|---|---|
| 1,813,798 | 7/1931 | Gerosa | 52/543 |
| 1,941,216 | 12/1933 | McKeown | 52/548 |
| 2,037,163 | 4/1936 | Guy | 52/548 |
| 2,176,156 | 10/1939 | Tamalunas | 52/548 |
| 2,724,303 | 11/1955 | Holcomb | 52/543 |
| 2,828,701 | 4/1958 | Freed | 52/548 |
| 3,646,717 | 3/1972 | Parker | 52/548 |
| 3,729,045 | 4/1973 | MacDonald | 160/380 |
| 4,193,235 | 3/1980 | Cucchiara | 52/222 |
| 4,314,433 | 2/1982 | Hulcombe | 52/547 |
| 4,630,422 | 12/1986 | Beneze | 52/410 |

*Primary Examiner*—John E. Murtagh

*Attorney, Agent, or Firm*—Foley & Lardner

[57] ABSTRACT

A device suitable for fastening a roofing membrane to a roofing surface comprises a pair of stress reliever plates, preferably coupled along one edge. Membrane engagement members, such as spikes, extend A device suitable for fastening a roofing membrane to a roofing surface comprises a pair of stress reliever plates, preferably coupled along one edge. Membrane engagement members, such as spikes, extend from the inner surface of one plate toward the other plate and are received in holes provided in the other plate. In the preferred embodiment, the two plates are coupled to one another by coupling or hinge systems, and a method for using the device is disclosed which comprises placing the fastener at the edge of the membrane material. Use of the dual plate stress reliever in combination with the membrane engaging the spikes provides a system with high resistance to lateral pullout and a system which is easy to install. Wrinkling of the membrane during fastener installation is also minimized.

6 Claims, 2 Drawing Sheets

ROOF FASTENER ASSEMBLY INCLUDING A DUAL PLATE STRESS RELIEVER

BACKGROUND CF THE INVENTION

1. Field of the Invention

This invention relates generally to a fastener used for installing a waterproof membrane on a roof. More particularly, it relates to a stress reliever assembly having top and bottom portions through which at least one screw is inserted to secure the membrane to the roof.

2. Description of the Prior Art

A variety of screw and stress reliever type fastener systems have been designed for securing roof covering materials to roof decks made of steel, gypsum, tectum, or wood. Such roof covering materials typically include a water impervious membrane, and frequently include successive layers of materials; insulation is frequently placed between the deck and the membrane. Such systems generally include an elongated screw which penetrates a flat plate (washer). The plate (sometimes referred to as a stress plate) urges the roof covering membrane and insulation downwardly when the screw is tightened to a rooftop sublayer and tends to prevent the membrane from pulling vertically or horizontally over the head of the screw.

Screw and plate fasteners are most frequently used on commercial buildings having a flat roof. In general, a layer of insulation is frequently placed over a deck. Membrane, typically marketed in rolls, is then laid out over the insulation. The membrane edges along the perimeter of the roof are usually fixed by battons or other conventional techniques. Fasteners are then installed along the interior edge of the membrane sheet, the distance from the edge and the distance between fasteners being determined in accordance with the types of decking and insulation material used and the anticipated conditions. More specifically, a minimum force which will cause the membrane to tear away from the fastener (or the fastener to pull out of the roof) is prescribed by the architect or designer. The number of fasteners per unit linear distance is chosen to ensure that the membrane will be retained.

To install a typical fastener, a pilot hole may be employed. If so, it is first drilled at the desired location through the roof membrane, insulation, and deck. A plastic or metal screw is inserted through a retaining stress plate and then driven into the hole, engaging the roof deck so that the plate is held tightly against the membrane. After the fasteners have been installed along the edge of the first sheet, a successive sheet of membrane is arranged with one edge overlapping the edge of the first sheet of membrane, thereby covering the fasteners. That overlapping edge of the successive sheet is bonded (e.g., chemically or by heating) to the sheet secured by the fasteners. The other edge of the succeeding sheet is fixed to the insulation and deck by fasteners in the manner previously described. Thus, the roof is covered by overlapping sheets of membrane.

Metal screws with plastic plates proposed for use as roofing anchors are described in, for example, DeCaro U.S. Pat. No. 4,361,997 issued Dec. 7, 1982; Hartman U.S. Pat. No. 4,780,039, issued Oct. 25, 1988; Dewey U.S. Pat. Nos. 4,380,413 and 4,545,270, issued Apr. 19, 1983 and Oct. 8, 1985, respectively; and Hasan U.S. Pat. No. 4,663,910, issued May 12, 1987, U.S. Pat. No. 4,712,959, issued Dec. 15, 1987, and U.S. Pat. No. 4,757,661, issued July 19, 1988.

Problems have been encountered when conventional screw and plate fasteners are employed in such roof applications. Wind blowing over the membrane tends to create a negative air pressure, which in turn tends to cause the membrane to pull laterally from the fastener. To assist in preventing the membrane from tearing out from the fastener due to such lateral forces, downwardly directed cleats, lugs, spikes, ribs or other protrusions on the underside of the stress plate have been provided. These engage the membrane as the screw is tightened into the rooftop. See, for example, Murphy U.S. Pat. No. 4,787,188, issued Nov. 29, 1988; Reinwall, et al U.S. Pat. No. 4,726,164 issued Feb. 23, 1989; and Francovitch U.S. Pat. No. 4,476,660, issued Oct. 16, 1984. However, such plates are typically not suitable for certain types of roofs, particularly those roofs sometimes used in warm climates, where the membrane is applied directly over a deck of relatively hard material, without intervening insulation. Also, in some applications where particularly tough membranes are employed or low density insulation is used, the protrusions sometimes fail to adequately engage the membrane. Further, over time the screw tends to cease to provide the original level of preload tension relative to the membrane. This may happen because the insulation deteriorates and shrinks due to, e.g., harsh weather conditions, or because vibrations cause the screw to back out from the deck material. Such a loss of tension can also cause the lugs on the underside of the stress plate to lose engagement with the membrane, making the membrane more susceptible to pull out due to lateral forces. These conditions can also result in the head of the screw popping out, i.e., protrude from the surrounding roofing material, which in turn leads to damage to the overlying membrane.

A number of mechanical systems have been proposed for preventing separation of the screw from the plate in roofing fasteners. Back out can be prevented by preventing the screw from turning (in a reverse direction) relative to the roof. This could be accomplished with a broad headed screw having lugs, spikes, ribs or the like on the underside of the head which would engage the membrane and prevent counter-rotation. However, rotation of such devices, during installation would tend to tear or otherwise damage the membrane. Accordingly, fastener systems have been proposed which include a plate with anti-rotation structure (such as spikes) to engage the membrane, a screw, and a mechanism to prevent counter-rotation of the screw relative to the plate. Such a system is described in the aforementioned Dewey U.S. Pat. No. 4,380,413. Projecting pawls on the head of the screw, cooperate with projections on a plate, much like a ratchet system, to prevent counter-rotation after installation.

A similar system employing a ratchet mechanism to prevent a screw from backing out is described in Giannuzzi U.S. Pat. No. 4,763,456, issued Aug. 16, 1988. However, these various ratchet structures tend to give the fastener assembly an undesirably high profile, and may be susceptible to failure due to loss of tension or breakage of the ratchet members if overtightening occurs. Other systems employ a threaded connection between the plate and fastener. For example, the aforementioned DeCaro U.S. Pat. No. 4,361,997 describes a fastener with upper and lower sets of threads with an intervening unthreaded area which cooperates with a stress plate having anti-rotation structures on its underside. The lower set of threads are coupled to the plate prior to installation. The upper threads engage the plate after the screw is substantially driven into the roofing deck. The anti-rotation structures engage the roof membrane and prevent the plate from turning.

The prior art stress reliever plates are disadvantageous in a number of respects. Perhaps most importantly, the interaction of the teeth, spikes or lugs on the underside of the stress reliever plate may cause wrinkles in the membrane during tightening of the anchor. In addition, the profile of the stress reliever plate and anchor must be relatively low and without sharp corners so that the membrane will not be torn if the anchor is stepped on. The spikes must be sufficiently thick to withstand lateral forces exerted by wind lift. However, the bigger the spike, the more wrinkles created in the membrane, and the spike must be sufficiently sharp (pointed) to penetrate the membrane. Metal stress relievers provide strength, but tend to be corrosive, and in some instances, are subject to galvanic effects.

Other systems have been proposed which employ a cap over the head of the fastener (see, e.g., Verble U.S. Pat. No. 4,658,558, issued Apr. 12, 1987; Francovitch U.S. Pat. No. 4,520,606, issued June 4, 1985; Beneze U.S. Pat. No. 4,620,402, issued Nov. 4, 1986) or resilient spring mechanisms to maintain tension (see, e.g., Hewison U.S. Pat. No. 4,616,455, issued Oct. 14, 1986). Application of a bonding or sealing agent over the head of a fastener, between a stress reliever plate and the membrane, or both have also been proposed. See Sandquist U.S. Pat. No. 4,074,501, issued Feb. 21, 1978, and Francovitch U.S. Pat. Nos. 4,455,804 and 4,467,581, issued June 26, 1984 and Aug. 28, 1984, respectively. Still other systems rely on a nut or similar element disposed on the lower end of the screw beneath the rooftop to hold the fastener in place. See Sargent U.S. Pat. No. 4,727,699, issued Mar. 1, 1988. These fasteners are only partly effective in preventing the fastener from backing out and require additional structure for that purpose.

Roofing fastener systems with provisions for preventing the head of the screw from protruding beyond the top of the plate, e.g., in the event of loss of installation tension, have also been proposed. For example, a system where the washer includes a flexible ring about the aperture that receives the screw is described in Dewey U.S. Pat. No. 4,380,413. Another such system employing a plastic washer having a resilient rib which engages the screw head to hold it in place is described in the aforementioned Hasan Pat. Nos. 4,712,959 and 4,757,661.

Another class of membrane fasteners includes multiple components for engaging the membrane, in addition to the fastener used to secure at least one of the components to the roof. Examples of such fasteners are described in Francovitch U.S. Pat. No. 4,520,606, issued June 4, 1985 (a lower plate is secured to the The intermediate membrane layer by linear fasteners passing into the lower plate or by head and socket engagement); Hickman U.S. Pat. No. 4,586,301, issued May 6, 1986 (a core with outreaching arms is secured to the roof, is covered by the membrane, and secured in place by a clip which fits over the core unit cooperating with a locking clamp); Tomaszewski U.S. Pat. No. 4,617,771 issued Oct. 21, 1986, Boginski U.S. Pat. No. 4,624,092 issued Nov. 25, 1986, Backenstow, et al U.S. Pat. No. 4,649,686 issued Mar. 17, 1987, and Marston U.S. Pat. No. 4,651,490 issued Mar. 29, 1987 (snap-like fasteners wherein a lower member having an annular boss is anchored to the roof, the membrane is draped over the lower member, secured in place by a snap ring secured to the boss, and a locking cap is added); Tripp U.S. Pat. No. 4,744,187 issued May 17, 1988, (upper and lower plates with a series of annular concentric ridges); and Gasser U.S. Pat. No. 4,757,662 issued July 19, 1988 (a two-part locking ring-type fastener). The major problem with these multi-component fasteners is that they have unacceptably high profiles. Furthermore, numerous parts must be employed during the membrane installation process.

In fields totally unrelated to the field of the present invention, devices have been described which include generally parallel plates with a hinge or coupling system along one edge and a series of pins extending upwardly from one plate toward the other. See the clothing fabric fastening device of Trundy U.S. Pat. No. 3,149,386 issued Sept. 22, 1964. In another device (Burns U.S. Pat. No. 4,378,617, issued Apr. 5, 1983) used to suspend agricultural shade cloth, shaft-like pins extend into holes in the top plate. Apertures are provided in the illustrated embodiment for lashing ropes and the like.

Despite the large number of fasteners available, a need remains for a roof fastening system that provides a high pull out rating, simplicity in structure and ease of installation. A fastener which would avoid wrinkling of the membrane during installation and which would apply equalized pressure to the membrane under a stress plate would also be highly desirable.

SUMMARY OF THE INVENTION

The present invention provides a roof membrane fastener which overcomes the aforementioned drawbacks of previously known fasteners.

The present invention, in its various aspects provides, inter alia:

a stress reliever roof fastener which provides a high degree of resistance to lateral pullout of the membrane from the fastener, and thus permits increased spacing between fasteners;

a low profile fastener;

a stress reliever that is capable of accepting a plurality of roof fastening screws;

a roof fastener which is easy to install, and quickly located on the edge of a strip of roof membrane;

a roof fastener which is used on the edge of a membrane sheet, thereby reducing the amount of membrane material used for a particular roofing job;

a roof fastener stress reliever having teeth which penetrate roofing membrane with a minimum of wrinkling of the membrane;

a roof fastener stress reliever which may be made in a variety of sizes for different roofing applications; and a roof fastener stress reliever which creates a vice-like clamping pressure.

How the foregoing are accomplished will be described in the following detailed description of the preferred and alternate embodiments. Generally, however, a dual plate device is adapted to be placed at the edge of a membrane sheet, the two plates being rotatably coupled along one edge by coupling elements or a hinge. Spikes are provided on one or both inner surfaces of the plates, and in the preferred embodiment, each spike has a mating hole in the opposite plate to receive the pointed ends of the spikes as the two plates are drawn together during fastener installation. Mating aperatures, at least one pair per fastener, are provided to receive a fastening screw, which during installation penetrates the top plate, the membrane, the bottom plate and, in turn, the underlying roofing material. Various configurations for the fastener will be illustrated below, and it will be evident to those skilled in the art after reading the present specification that other modifications can be made to the disclosed embodiments without departing from the spirit or intended scope of the present invention. Such other modifications are deemed to fall within the scope of this invention if they or their equivalents fall within the scope of the claims which are appended hereto.

BRIEF DESCRIPTION OF THE DRAWING

Preferred and alternate exemplary embodiments of the present invention will hereinafter be described in conjunction with the appended drawing wherein like designations denote like elements, and.

DESCRIPTION OF THE PREFERRED EXEMPLARY EMBODIMENT

Before proceeding to the description of the FIGURES, it should be pointed out that the shapes of the fasteners disclosed herein are preferred and illustrative, but the shapes are not limiting with respect to the present invention. Moreover, the thicknesses of the plates, spike patterns, hole depths, aperture diameters and plate coupler or hinge systems may be varied and still result in a fastener in acccordance with the present invention set forth above.

Figure 1:
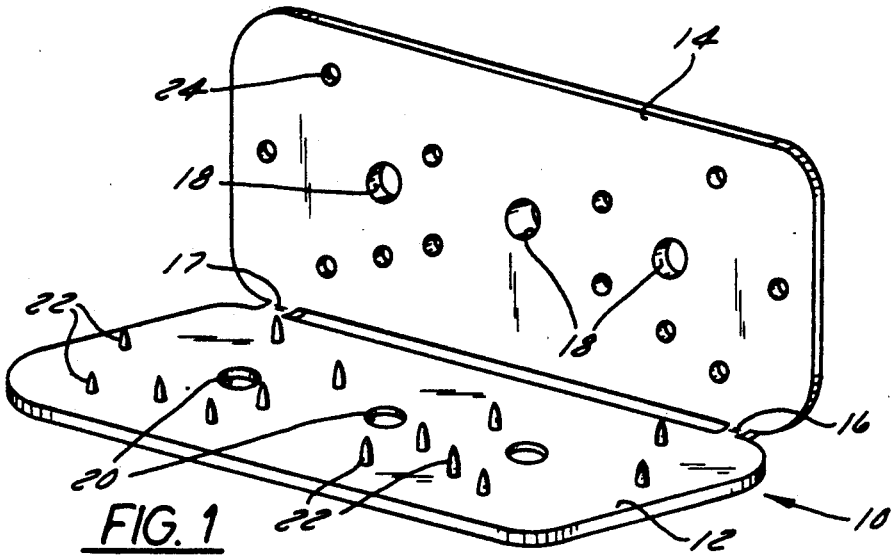
FIG. 1 is a perspective view of a roof fastener according to the preferred embodiment of the present invention, showing the fastener plates opened.
Figure 2:
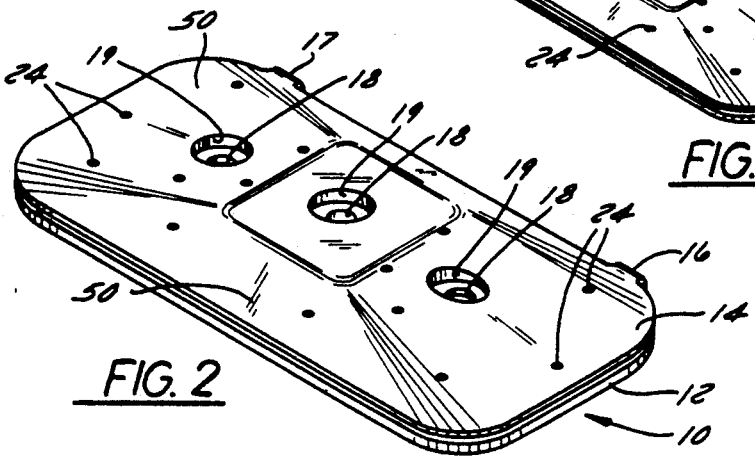
FIG. 2 is a perspective view of the fastener shown in FIG. 1 with the plates of the fastener in a closed position.

Referring to FIGS. 1, 2, 4 and 5, a roof fastener stress reliever 10 according to the preferred embodiment of the present invention includes a lower plate 12 and an upper plate 14. Plates 12 and 14 are preferably coupled along one edge by flexible, spaced apart coupling elements 16 and 17 in such a way that plates 12 and 14 may close, one upon the other, to form overlapping plates with aligned edges as shown in FIG. 2. The inner surfaces of plates 12 and 14 preferably correspond in elevational contour, and are suitably generally planar. In the illustrated embodiment, plates 12 and 14 are generally rectangular with rounded corners. Square plates, or plates having other configurations, may also be employed. The dimensions also can be varied depending upon the type of roofing application involved. In the most preferred three-quarters inches ($1\frac{3}{4}''$) wide by about three and one-half inches ($3\frac{1}{2}''$) long.

Figure 4:
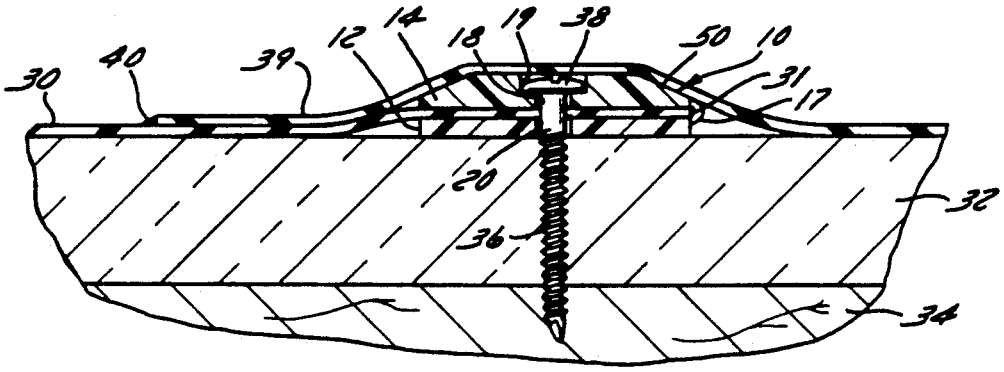
FIG. 4 is a sectional view of the fastener of FIG. 2 taken along the line 4—4 thereof and including a shaft fastener and certain roof components therewith.

As seen by reference to FIGS. 1, 2 and 4, one or more apertures 18 are provided in plates 12 and 14 to receive a shaft fastener 36, e.g. a screw, used to attach the fastener assembly to the roof structure. In the preferred embodiment, three such apertures are provided along the longitudinal axis of the fastener 10, with counter sunk portions 19 being formed in plate 14 and simple holes formed in bottom plate 12. The axis of the apertures 18 and holes 20 are aligned when stress reliever 10 is in the position shown in FIG. 2.

Figure 3:
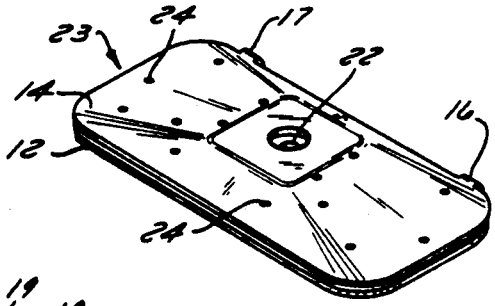
FIG. 3 is a perspective view of a roof fastener according to an alternate embodiment of the present invention.

The number of shaft fastener holes provided can vary depending upon the size and shape of the stress releiver embodying the principals of the present invention, and an alternative embodiment 23 is shown in FIG. 3. In that FIGURE, a single aperture 22 is provided for stress reliever 23. In all other respects, stress reliever 10 and stress reliver 23 are identical. Extended length battons in accordance with the present invention, adapted for use with a multiplicity of spaced apart screws, are similarly contemplated.

Figure 6:
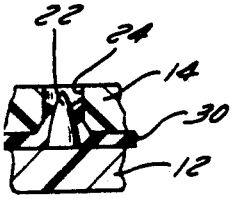
FIG. 6 is a side sectional view showing in detail the top and bottom plates of a roof fastener according to an embodiment of the present invention and showing a tooth component thereof.

As best seen in FIGS. 1, 4 and 6, a plurality of pointed spikes 22 are provided extend upwardly from the inner surface of bottom plate 12, disposed in a predetermined pattern to be received in corresponding holes 24 in upper plate 14 when plates 12 and 14 are closed. The particular arrangement of the spikes shown in FIG. 1 is for purposes of illustration only, and the pattern may vary widely, depending upon the shape and size of the fastener involved. It is important that the spikes be pointed, but they may be shaft-like with a pointed end, as opposed to the conically shaped spikes presented in the illustrations. In the preferred embodiment, the spikes will pass into the holes but will not protrude above the top surface of upper plate 14 when the fastener is in the closed position, as illustrated in FIGS. 2 and 3. Spikes employed in the preferred embodiment are one-eighth inch ($\frac{1}{8}''$) in height and one thirty-second inch (1/32") in diameter at the base.

Figure 5:
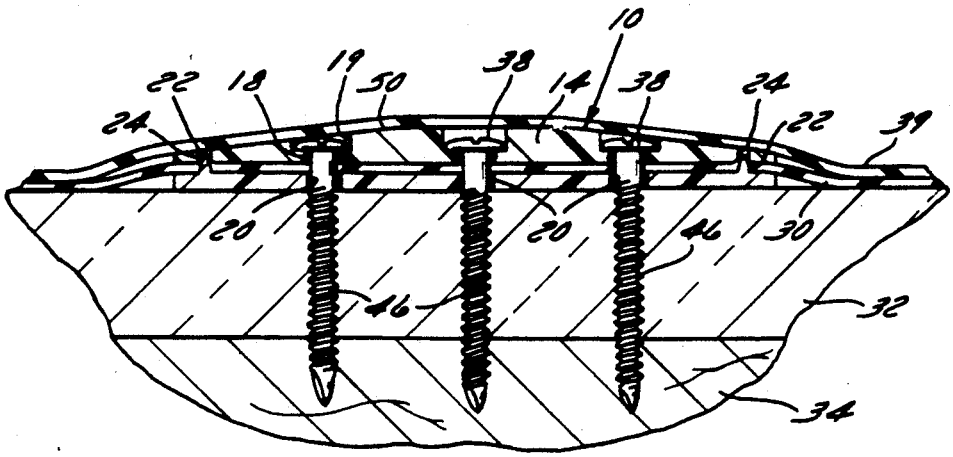
FIG. 5 is a sectional view of the fastener of FIG. 2 taken along the line 5—5 thereof and including three shaft fasteners and certain roof components associated therewith.

Referring now to FIGS. 4, 5 and 6, the installation of a fastener assembly employing stress reliever 10 will be described. A roof membrane 30 is laid out overlaying a roofing structure; e.g. a layer of insulation 32 lying over a tectum deck 34. Lower plate 12 is then inserted under membrane 30, with the bottom of lower plate 12 resting on the uppermost layer of a roof structure, e.g. insulation 32. Plate 12 is disposed such that edge 31 of membrane 30 aligns with the outer edge of plate 12, e.g. is received against coupling elements 16 and 17. Upper plate 14 is then closed against membrane 30, to sandwich membrane 30 between plates 12 and 14.

A shaft fastener (e.g. screw) 36 having a head 38 is received within the counter-sunk portion 19 of hole 18 and engages the underlying roof structure. As fastener 36 engages, e.g. is turned into the roof structure, the top plate 12 is drawn downwardly toward plate 12 and spikes 22 penetrate membrane 30 and are received in holes 24 as is best seen in FIG. 6. The penetration of the conically shaped spikes causes the membrane material, which is typically elastomeric, to similarly be received in holes 24 and to sealingly engage the side walls of holes 24. As illustrated in FIG. 6, teeth 22 may penetrate membrane 30 to the point of puncturing the membrane. This provides maximum resistance against lateral pull out, and, in view of the sealing engagement between membrane 30 and the side walls of holes 24, the structure is not rendered greatly susceptible to leakage by virture of the puncture. In any event, penetration of membrane 30 by spikes 22 without puncturing, will suffice in many applications. Indeed, stretching membrane 30 so that it is securely engaged between spikes 22 and the side walls of holes 24, with minimal penetration will suffice in some applications.

The cooperation of spikes 22 and the holes 24 permit use of spikes sufficiently sharp to facilitate engagement, and penetration of membrane 30 without wrinkles. Since spikes 22 are received in holes 24, when installed, upper plate 14 provides lateral support and reinforcement against lateral forces. Thus, spikes 22 of lesser diameter, and thus stronger and more able to penetrate membrane 30, can be employed as compared to the prior art, thus facilitating piercing the membrane with relatively little wrinkling. The necessary strength against lateral forces is provided by the cooperation with holes 24. Further, the clamping action of plates 12 and 14, under the bias of shaft fastener 36, tend to, in effect, iron out any wringles caused by penetration.

If desired, to facilitate penetration of membrane 30 by the spikes 22 furthest from hole 18, the elevational contour of upper plate 14 can be slightly convex, rather than planer. As fastener 36 biases plates 12 and 14 together, force tends to be concentrated in the vicinity of hole 18. A slight convexity in the upper plate tends to provide additional force at the periphery of the plates, such that force is more evenly distributed across the plates, and facilitating penetration of membrane 30 by the outer spikes.

Figure 7:
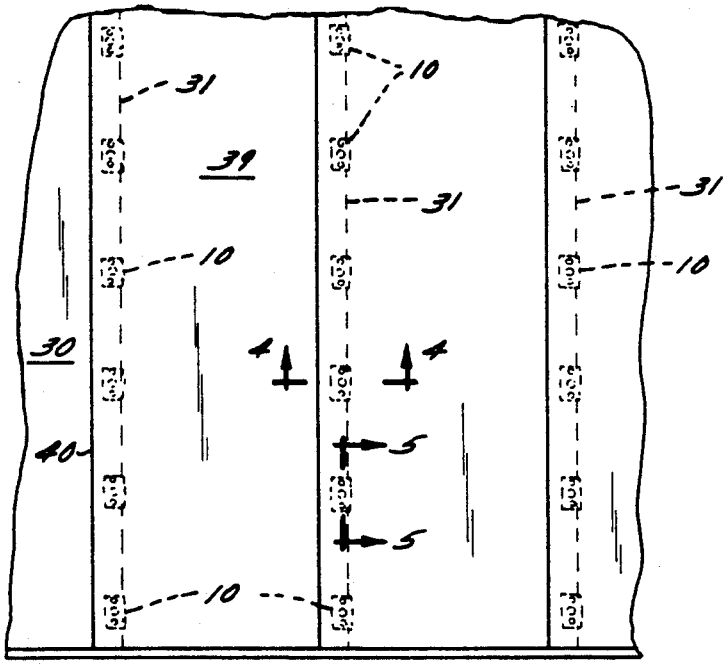
FIG. 7 is a top diagramatic view illustrating the use of the fastener of the preferred embodiment of the invention for securing edges of roofing material, in sequence, on a roof structure.

Referring now to FIG. 7, fastener assemblies employing stress relievers 10 are disposed at spaced intervals, along the edge of membrane 30. In view of the increased pull out resistance, the spacing intervals can often be increased, as compared to fastener assemblies using prior art stress plates. As shown in FIGS. 4 and 7, a success sheet of membrane 39 is arranged with one edge overlapping stress relievers 10.

The superimposed edge of membrane 38 is bonded, in a conventional manner (e.g. chemically or heat sealed) to membrane 30 at area 40. The opposite edge of membrane 38 is similarly secured in place using fasteners 10 as is illustrated in FIG. 7. The process is repeated until the roof is covered.

FIG. 5 shows a different view of the preferred embodiment. FIG. 5, however, also illustrates another potential fastening technique in which the fasteners 46 used therein are coated at the area immediately below the head with a thermoplastic resin which may be melted into sealing engagement with top plate 14 as the fasteners are rapidly rotating into the insulation and decking. The technique of spin or friction welding is well known in areas other than roof fasteners and is the subject a patent granted to the present inventor under which U.S. Pat. No. 4,987,714 issued Jan. 29, 1991 this spin welding technique will not be described in this application, but they are incorporated herein, in their entirety, by this reference to U.S. Pat. No. 4,987,714.

Referring again to FIGS. 2, 4 and 5, it will be noted that the upper surface of upper plate 14 is configured with tapered portions 50 which extend from the center line of the plate toward the edges thereof. The principal reason for this configuration is to provide as low a profile as is possible, while providing an area for receiving the heads 38 of the fasteners and sufficient strength of the upper plate 14 below the screw heads. Along the edges, plate 14 can be quite thin to achieve the low profile objective. In addition, the gradual reduction in the thickness of the upper plate 14 toward the membrane 30 reduces the likelihood of membrane tearing if one were to walk on the roof or otherwise exert downward force on the covering membrane 39 or the fastened membrane 30 adjacent the edges of fastener 10.

The materials of construction which may be employed for fastener 10 can be selected from a wide number of metals or plastic materials. In the preferred embodiment, plastics are used for ease of fabrication and to avoid corrosion which can sometimes occur in roofing applications. A preferred plastic is nylon.

While not shown in the FIGURES, it should also be apparent that spikes 22 could be provided in the upper surface instead of, or in addition to, the spikes 22 provided in plate 12. Holes 24 would then be provided in plate 12 to receive such spikes. Whether spikes are provided only on plate 12, on plate 14 or on both plates, the sharp, penetrating points of the spikes will assist in an evening out of membrane 30 and an ironing out of any wrinkles which may tend to develop during fastener installation.

The stress reliever of the present invention provides an extremely high resistance to lateral pull-out of the membrane and provides the additional advantage of saving membrane material as can best be appreciated by reference to FIG. 7. Unlike prior fasteners which were typically mounted inwardly of the edge of a sheet of membrane and required a concomitant overlap of the adjacent sheet of membrane, fastener 10 is located directly on the edge, saving as much as one inch (1") of membrane per strip. For large roofing installations, the overall membrane and labor savings would be substantial.

While several embodiments of the present invention have been described in the foregoing specification, such descriptions and the drawings are for purposes of illustration and the invention is to be limited solely by the scope of the claims which are appended hereto.

What is claimed is:

1. A roof stress reliever for cooperating with a fastener to secure a roofing membrane to a roof deck, comprising:

a first oblong plate having a generally planar surface;

a second oblong plate constructed of a thermoplastic resin and having a generally planar surface;

means for rotatively coupling said plates so that said surfaces may conform to one another or be spaced apart from one another;

at least one pair of fastener receiving holes passing through said plates, said holes being aligned when said surfaces conform against one another;

engaging means disposed on at least one of said plate surfaces for engaging said membrane and extending into but not through the opposing one of said plates; and a receptacle for each of said engaging means located in the plate opposing the plate from which said engaging means extend, wherein said fastener includes a head and a thermoplastic resin coating on at least that portion of said fastener adapted to contact the fastener receiving hole of said second plate, whereby a friction weld can be formed upon rapid rotation of said fastener relative to said second plate.

2. The stress reliever of claim 1 wherein said engaging means comprise a plurality of spikes.

3. A method of securing a roofing membrane to a roofing surface, comprising the steps of:

sandwiching said membrane between generally conforming, generally planar surfaces of first and second stress reliever plates;

engaging said membrane between said plates by penetrating said membrane with a plurality of spikes formed on one of said plate surfaces;

passing at least one shaft fastener through said sandwich of said plates and membrane and into said roofing surface for compressing said second plate downwardly toward said first plate; and securing said stress reliever and membrane to said roof.

4. The method of claim 3 wherein at least said second plate is formed of a thermoplastic resin and wherein said shaft fastener includes a head and a thermoplastic resin coating on at least that portion of said shaft fastener adaptable to contact said second plate, said method further comprising the step of rapidly rotating said shaft fastener relative to said second plate to form a friction weld therebetween.

5. The method of claim 3, wherein said spikes extend from one of said plates into but not through the other of said plates.

6. A method of securing a roofing membrane to a roofing surface, comprising the steps of:

sandwiching said membrane between generally conforming, generally planar surfaces of first and second stress reliever plates, said second plate being made of a thermoplastic resin;

engaging said membrane between said plates;

passing at least one shaft fastener through said sandwich of said plates and membrane and into said roofing surface for compressing said first plate downwardly toward said second plate, said shaft fastener including a thermoplastic resin coating on at least that portion of said shaft fastener adaptable to contact said second plate; and securing said stress reliever and membrane to said roof by relatively rotating said shaft fastener relative to said second plate to form a friction weld therebetween.

* * * * *